US006019858A

United States Patent [19]

Sienkowski et al.

[11] Patent Number: 6,019,858

[45] Date of Patent: Feb. 1, 2000

[54] ZINC PHOSPHATE CONVERSION COATING AND PROCESS

[75] Inventors: Michael L. Sienkowski, Warren; Gerald J. Cormier, Troy, both of Mich.

[73] Assignee: Henkel Corporation, Gulph Mills, Pa.

[21] Appl. No.: 09/189,623

[22] Filed: Nov. 10, 1998

Related U.S. Application Data

[63] Continuation of application No. 08/663,374, Jun. 13, 1996, abandoned, which is a continuation of application No. 08/440,044, May 12, 1995, abandoned, which is a continuation of application No. 08/123,500, Sep. 17, 1993, abandoned, which is a continuation-in-part of application No. 08/736,835, Jul. 29, 1991, abandoned.

[51] Int. Cl.[7] ..... C23C 22/07

[52] U.S. Cl. ..... 148/260; 148/261; 148/262

[58] Field of Search ..... 148/260, 261, 148/262

[56] References Cited

U.S. PATENT DOCUMENTS

| | | | |
|---|---|---|---|
| 4,865,653 | 9/1989 | Kramer | 148/262 |
| 5,238,506 | 8/1993 | Cape et al. | 148/262 |

*Primary Examiner*—Prince Willis
*Assistant Examiner*—Andrew L. Oltmans
*Attorney, Agent, or Firm*—Wayne C. Jaeschke; Norvell E. Wisdom, Jr.; Wayne C. Jaeschke, Jr.

[57] ABSTRACT

Concentrates containing (a) an hydroxylamine sulfate accelerator, and (b) zinc, nickel, manganese, and phosphate ions are formulated into aqueous coating solutions for treating metal surfaces, such as ferrous, zinc, and aluminum surfaces. In the process of using this solution, hydroxylamine ions become depleted or reduced in concentration in the applied solution. A replenishing solution is added for reusing the solution until the replenished coating solution reaches a sulfate level of no more than 14 g/l.

10 Claims, No Drawings

ZINC PHOSPHATE CONVERSION COATING AND PROCESS

CROSS-REFERENCE TO RELATED APPLICATION

This application is a continuation of U.S. patent application Ser. No. 08/663,374 filed on Jun. 13, 1996 now abandoned; which is a continuation of 08/440,044 filed on May 12, 1995 (now abandoned); which is a continuation of U.S. patent application Ser. No. 08/123,500 filed on Sept. 17, 1993 (now abandoned); which is a continuation-in-part of U.S. patent application Ser. No. 736,835 filed Jul. 29, 1991 (now abandoned). Each of these applications is herein incorporated by reference.

BACKGROUND OF THE INVENTION

1. Field of the Invention

This invention relates to zinc phosphate coatings for metal surfaces and to processes for phosphatizing a metal surface with acidic aqueous phosphate solutions. The invention is applicable to a variety of substrates including cold rolled steel ("CRS"), zinc alloys, and aluminum.

2. Statement of Related Art

Present day phosphate coating solutions are generally dilute aqueous solutions of phosphoric acid and other chemicals which, when applied to the surface of an active metal, react with the metal surface to form on the surface of the metal an integral layer of a substantially insoluble amorphous or coating. Generally, the crystalline coatings are preferred.

Typically the solutions include phosphate ions, zinc and other metal ions, especially manganese, nickel, and other divalent metal cations, to provide specific characteristics desired in the final coating. Other ions typically present may be nitrate, nitrite, chlorate, fluoborate or fluosilicate. A typical phosphating process comprises the following sequence of process steps: (1) cleaning and conditioning; (2)phosphating itself; and (3) post treating. Rinses are generally employed between each of the noted steps to prevent or at least reduce carry over of materials to the next step.

Despite advances in both the composition of the phosphate coating solution and the phosphating process, there is a continued demand for still further improvements in the compositions and processes, in order to provide more control over the process, assure adequate coating weights, reduce formation of scale or white spots, and reduce adverse environmental impact and safety hazards.

DESCRIPTION OF THE INVENTION

In this description, except in the claims and operating examples or where explicitly otherwise indicated, all numbers describing amounts of ingredients or reaction or usage conditions are to be understand as modified by the word "about" in describing the broadest scope of the invention. Practice within the numerical limits stated is generally preferred.

Also, unless expressly stated to the contrary:

percent, "parts of", and ratio values are by weight;

the term "polymer" includes oligomer;

the description of a group or class of materials as suitable or preferred for a given purpose in connection with the invention implies that mixtures of any two or more of the members of the group or class are equally suitable or preferred;

description of constituents in chemical terms refers to the constituents at the time of addition to any combination specified in the description, and does not necessarily preclude chemical interactions among the constituents of a mixture once mixed;

specification of materials in ionic form implies the presence of sufficient counterions to produce electrical neutrality for the composition as a whole (any counterions thus implicitly specified should preferably be selected from among other constituents explicitly specified in ionic form, to the extent possible, otherwise such counterions may be freely selected; and except for avoiding counterions that act adversely to the stated objects of the invention): and the term "mole" and its variations may be applied to elemental, ionic, and any other chemical species defined by number and type of atoms present, as well as to compounds with well defined molecules.

SUMMARY OF THE INVENTION

It has now been discovered that certain zinc phosphate compositions containing both nickel and manganese along with hydroxylamine sulfate ("HAS") as an accelerator provide polycrystalline coatings and retain the advantages of the use of manganese and nickel and the accelerator properties of the HAS, without changing the platelet or needle like crystalline morphology, as described in U.S. Pat. No. 4,865,653. The HAS accelerated zinc phosphating compositions of the present invention produce a desirable uniform gray manganese and nickel modified zinc phosphate coating on a variety of substrates including ferrous alloys, zinc alloys and aluminum and its alloys at desirable temperatures in the range of 38 to 66° C., preferably 46 to 54° C., and can be applied by both spray and/or immersion and by any other method that establishes contact between the compositions and the substrates. The hydroxylamine sulfate accelerator can be incorporated into the makeup and replenishing mixtures, when needed, without the need of traditional supplemental accelerators, such as nitrite, which are undesirable because of their chemical instability and consequent unsuitability to single package concentrates from which a complete working composition can be prepared by dilution with water only. Compositions according to the invention are also highly tolerant of sulfate ions, which may be introduced into the compositions during use.

In addition to providing overall desirable advantages, without many of the disadvantages previously encountered in the art, the present invention provides for improved process uniformity at the low temperature and reduces adverse environmental impact and safety hazards associated with nitrite. The polycrystalline coating contains Zn, Mn and Ni in the coating, and Fe in coatings on ferrous surfaces.

The present invention also includes as one embodiment a make-up or concentrate composition, which may then be diluted with water to form an aqueous, acidic coating solution for a spray or immersion coating process.

DESCRIPTION OF PREFERRED EMBODIMENTS

In general, a composition according to the invention, used for actual contact with a metal substrate to form a phosphate conversion coating, preferably will contain, more preferably will consist essentially of, or still more preferably will consist of water and:

| INGREDIENT | CONCENTRATION (WT %) |
|---|---|
| $PO_4$ ions | 0.5 to 2.5% |
| Zn ions | 0.05 to 0.2% |
| Ni ions | 0.02 to 0.15% |
| Mn ions | 0.02 to 0.15% |
| HAS | 0.1 to 0.25% |
| $NO_3$ ions | 0 to 0.2% |
| Fluoride ions | 0 to 0.15% |
| Sulfate ions | 0 to 1.4% |

The stoichiometric equivalent as fluoride ions of any content of complex fluoride ions such as fluosilicate, fluotitanate, fluoborate, and the like is to be understood as included within the content of fluoride ions for the purpose of the preferred concentration ranges noted above.

The coating solution may be formed by diluting a concentrate containing the ingredients providing the foregoing concentration when the concentrate is diluted with water in an amount of 48 g/liter of concentrate. The concentrate is accordingly formulated to provide a coating solution preferably containing, more preferably consisting essentially of, or still more preferably consisting of water and:

(A) from 0.5 to 2 g/l, more preferably from 0.8 to 1.2 g/l of zinc ions;

(B) from 5 to 25 g/l, more preferably from 10 to 15 g/l, of phosphate ions;

(C) from 0.2 to 1.5 g/l, more preferably from 0.5 to 1 g/l, of manganese ions;

(D) from 0.2 to 1.5 g/l, more preferably from 0.5 to 1 g/l, of nickel ions;

(E) from 1 to 2.5 g/l, more preferably from 1.5 to 1.75 g/l, of hydroxylamine accelerator; and, optionally, (F) up to 1.5 g/l of total fluoride ion with, more preferably, a free fluoride content of 400–600 parts per million; and, optionally, (G) up to 2 g/l of nitrate ions; and, optionally, (H) up to 14 g/l, more preferably no more than 9.0 g/l, still more preferably no more than 6.0 g/l, of sulfate ions.

In the phosphating solutions, it is preferable that the weight ratio of zinc ion to phosphate ion be in the range from 1.0:10 to 1.0:25 and the weight ratio of zinc to the sum of manganese and nickel be in the range from 1.0:0.5 to 1.0:2.5, with the ratio of manganese to nickel being most preferably 1.0:1.0, with a ratio in the range from 1.0:0.5 to 1.0:1.5 being satisfactory.

The "free fluoride content" noted above is defined and can conveniently be measured by means of a fluoride sensitive electrode as described in U.S. Pat. No. 3,431,182 and commercially available from Orion Instruments. "Free fluoride content" as this term is used herein was measured relative to a 120E Activity Standard Solution commercially available from the Parker +Amchem ("P+A") Division of Henkel Corporation, Madison Heights, Mich. by a procedure described in detail in P+A Technical Process Bulletin No. 968. The Orion Fluoride Ion Electrode and the reference electrode provided with the Orion instrument are both immersed in the noted Standard Solution and the millivolt meter reading is adjusted to 0 with a Standard Knob on the instrument, after waiting if necessary for any drift in readings. The electrodes are then rinsed with deionized or distilled water, dried, and immersed in the sample to be measured, which should be brought to the same temperature as the noted Standard Solution had when it was used to set the meter reading to 0. The reading of the electrodes immersed in the sample is taken directly from the millivolt (hereinafter often abbreviated "v" or "mV") meter on the instrument and convened to parts per million by comparison with the millivolt readings obtained with solutions of known free fluoride content.

In the phosphating compositions of the present invention, it is desirable for the solution to have a total acidity of IS to 25, more preferably 17–22, most preferably 19–20, along with a free acidity of 0.3–1.0, more desirably 0.4–0.8, and most preferably 0.5–0.7. Acidity herein is expressed in points, in which by "points" as used herein is meant the milliliters ("ml") of 0.1 N NaOH required to titrate a 10 ml aliquot sample, to a pH of 8.2 with phenolphthalein indicator for total acid and to a pH of 3.8 with bromophenol blue indicator for free acid.

Suitable and preferred sources of the ingredients of the phosphating solutions of the invention include the following: for zinc ions: zinc oxide, zinc carbonate, zinc nitrate, etc.; for phosphate ions: phosphoric acid, zinc phosphate, zinc monohydrogen phosphate, zinc dihydrogen phosphate, manganese phosphate, manganese monohydrogen phosphate, manganese dihydrogen phosphate, etc.; for manganese ions: manganese oxide, manganese carbonate, manganese nitrate, the above manganese phosphate compounds, etc.; for nickel ions: nickel oxide, nickel nitrate, nickel carbonate, etc.; for fluoride ions: hydrofluoric acid, fluoboric acid, fluosilicic acid, fluotitanic acid, ammonium bifluoride, and their metal salts (e.g., zinc salt, nickel salt, etc.; for nitrate ions: nitric acid, nickel nitrate etc.).

Hydroxylamine is the essential accelerator in compositions according to the present invention and can be added to the concentrate before dilution to the coating solution. The hydroxylamine can be added in any suitable form, including any conventional source. The term "hydroxylamine accelerator" as used herein means any compound, such as a hydroxylamine salt or complex, that provides hydroxylamine in the compositions, usually by dissociation as the relatively small amount of free hydroxylamine in equilibrium with the hydroxylamine agent is consumed by the chemical reactions that produce the desired phosphate coating on the treated metal substrates. Suitable examples of hydroxylamine accelerators include hydroxylamine phosphate, nitrate, or sulfate, or mixtures thereof. More preferably, the hydroxylamine source is HAS, a stable form of hydroxylamine.

As stated above, the metal surfaces treated in accordance with the present invention include iron-based surfaces, zinc-based surfaces, aluminum-based surfaces, and their respective alloy-based surfaces. These metal surfaces can be treated either separately or in combination. Some advantages of the present invention are most prominently exhibited when the treatment is carried out on metal surfaces which include both an iron-based surface and a zinc-based surface, as, for example, on a car body.

It is conventional to perform other steps before and after the improved phosphating step of the present invention. Thus, it is advantageous to take steps to see that the part, workpiece or other article to be coated is substantially free of grease, dirt, or other extraneous matter. This is preferably done by employing suitable cleaning procedures and materials known to those skilled in the art. These would include, for example, mild or strong alkali cleaners, acidic cleaners, and the like. Such cleaners are generally followed and/or preceded by a water rinse. It is highly preferred to employ a conditioning step following or as part of the cleaning step. These conditioning solutions which are known to the art typically employ titanium phosphate compounds, and preferably including condensed phosphate(s).

After the coating is formed by application of the compositions of the invention, the coated article is preferably rinsed with water and dried. The drying may be accomplished by simple ambient air drying but a forced air drying at elevated temperatures often may advantageously be employed. In the coating step the temperature is preferably maintained at 46° to 54° C., although temperatures up to 66° C. are sometimes employed. At lower temperatures, longer time periods are typically required to achieve a uniform coating. Treatment times may vary from 30–180 seconds dependent on the temperature and technique of application.

Practical and preferred embodiments of the invention can be further illustrated by means of the following examples, which are not intended as limiting the invention.

EXAMPLE 1

In this example a concentrate is prepared from the following materials in the amounts indicated.

| MATERIAL | PARTS BY WEIGHT |
|---|---|
| $H_3PO_4$ (75% in water) | 390.0 |
| $HNO_3$ (42° Baumé) | 5.0 |
| Hydroxylamine Sulfate | 35.0 |
| MnO | 13.5 |
| ZnO | 26.0 |
| $Ni(NO_3)_2$ (30% solution in water) | 75.0 |
| $H_2SiF_6$ (25% in water) | 80.0 |
| HF (70% in water) | 7.0 |
| Water | 368.5 |
| Total | 1000.0 |

(Initially 331 parts of water were used to dissolve the other ingredients; then 37.5 additional pans were added at the end to make up a concentrate of 1000 parts total.)

The concentrate when diluted with water to provide a working composition containing 60 grams of the concentrate composition per liter of the working composition (this amount of dilution being briefly denoted hereinafter as "6% w/v") has a free acid ("FA") value of 15 points and a total acid ("TA") value of 42 points. The ratio of Mn to Ni ion is 1:1, the ratio of Zn ion to the sum of Mn to Ni ion is 1:1, and the ratio of Zn ion to phosphate ion is 1:13.7.

EXAMPLE 2

In this example, another concentrate is prepared from the following materials in the amounts indicated.

| MATERIAL | PARTS BY WEIGHT |
|---|---|
| $H_3PO_4$ (75%) | 390.0 |
| $HNO_3$ (42° Bé) | 5.0 |
| Hydroxylamine Sulfate | 35.0 |
| MnO | 21.5 |
| ZnO | 26.0 |
| $Ni(NO_3)_2$ Solution (30%) | 120.0 |
| HF (70%) | 7.0 |
| $H_2SiF_6$ (25%) | 80.0 |
| Water | 315.5 |

This concentrate when diluted with water to 6% w/v has an FA value of 13.5 and a TA value of 40. The ratio of Mn to Ni ion is 1:1, the ratio of Zn ion to the sum of Mn and Ni ion is 1:1.6, and the ratio of Zn ion to phosphate ion is 1:13.7.

EXAMPLE GROUP 3

This example will serve to illustrate a phosphating coating process according to the invention, employing the spray technique and using the concentrate of Example 1. The concentrate was diluted with water to a concentration of 48 grams of concentrate per liter of coating solution, and NaOH was added to reduce the free acid level of the coating solution to 0.7 points and a total acid to 20.

After degreasing and cleaning of 4 inch by 6 inch metal panels with a commercial alkaline cleaner (P+A Parco™Cleaner 1500C), followed by a water rinse, the panels were conditioned with a commercial titanium salt suspension (P+A Fixodine™Z8). The panels were then treated with the phosphate coating solution formed from the concentrate of Example 1 as noted above. After the phosphating treatment, the panels were water rinsed at ambient temperature using a 30 second water spray rinse followed by a 30 second deionized water spray rinse. The panels were then dried with forced air at ambient temperature.

The results of the phosphating coating at a temperature of 115° F. and a 120 second spray time were as shown in Table 1 below, with several example coatings on both cold rolled steel (CRS) and hot dipped galvanized (HDG).

TABLE 1

| | COATING WEIGHT ($MG/FT^2$) | |
|---|---|---|
| SAMPLE | CRS | HDG |
| A | 168 | 189 |
| B | 150 | 180 |
| C | 159 | 180 |
| D | 120 | 153 |
| E | 120 | 147 |
| F | 156 | 159 |
| G | 120 | 138 |
| H | 129 | 162 |
| I | 120 | 168 |
| J | 156 | 168 |
| K | 129 | 159 |
| L | 156 | 141 |
| M | 156 | 168 |
| N | 126 | 159 |
| O | 162 | 171 |
| P | 149 | 148 |
| Q | 121 | 156 |
| R | 117 | 153 |
| S | 121 | 151 |
| T | 136 | 156 |
| U | 120 | 145 |

The coatings were crystalline, platelet or needle-like, in structure with a crystal size in the range of 3–15 microns for the CRS and 2–10 microns for the HDG. Other samples were run at different spray times and temperatures, and visual observation of the coatings indicated that satisfactory coatings may be obtained at temperatures at least as low as 105° F., but higher temperatures are preferred.

EXAMPLE GROUP 4

A series of 4 inch by 6 inch panels of types 2036 and 5052 Aluminum were processed in the same manner as the CRS and HDG in Example 3, except that a potassium fluoride additive (8.6% free F ion, and 8.99% K ion) was employed to achieve a free fluoride level of 500–600 parts per million. Temperatures between 115–130° F. were acceptable although a 120 second time was required at the lower temperatures. The panels exhibited coating weights ranging from 122–173 $mg/ft^2$ for the aluminum 2036 alloy and 150–195 mg/ft$^2$ for the aluminum 5052 alloy. Crystal size varied from 5 to 30 microns for both alloys.

EXAMPLE GROUP 5

In this example, several different substrates were treated by a 60 second spray following the procedure of Example Group 3. In addition to the aluminum alloys and the cold rolled steel ("CRS"), two different electrogalvanized ("EG") substrates, and zinc-nickel alloy and "AO1" (a zinc-iron alloy) were treated. Results are shown in Table 2 below.

TABLE 2

| SUBSTRATE | COATING WEIGHT (MG/FT$^2$) | CRYSTAL SIZE (MICRONS) | VISUAL APPEARANCE | BATH TEMPERATURE (°F.) |
|---|---|---|---|---|
| CRS | 127 | 3–12 | GOOD | 120 |
| 90 EG | 180 | 2–8 | GOOD | 120 |
| NAT. 70/70 EG | 280 | 2–8 | GOOD | 120 |
| Zn-Ni | 164 | 3–10 | GOOD | 120 |
| AO1 | 183 | 3–10 | GOOD | 120 |
| 2036 Aluminum | 179 | 5–20 | GOOD | 130 |
| 5052 Aluminum | 195 | 5–18 | GOOD | 130 |

EXAMPLE GROUP 6

In this example group, the concentrate of Example 2 was employed to make the working solution, and, instead of the spray application in Example Group 3, the metal panels were immersed in a bath of the coating solution, which was again formed by diluting the concentrate to 48 g/l, as was done in Example Group 3. The results on various substrate panels (4 in.×6 in.) with a 2 minute immersion time at a temperature of 115° F. are shown in the following Table 3, which also illustrates the coating composition analysis.

TABLE 3

| SUBSTRATE | COATING WEIGHT (MG/FT$^2$) | COMPOSITION OF PHOSPHATE COATING FORMED, % OF: Zn | Ni | Mn | $PO_4$ | Fe |
|---|---|---|---|---|---|---|
| CRS | 177 | 27 | 1.3 | 2.9 | 38 | 9.5 |
| EG | 185.1 | 37.5 | 1.3 | 4.3 | 38 | 0.16 |
| HDG | 168.6 | 37 | 1.8 | 4.5 | 38.9 | 0.14 |
| Al 2036 | 168.6 | 29.9 | 2.2 | 6.7 | 42.5 | 0.32 |

In general, the crystal size was 1–5 microns for all substrates in this group. Also as in Example Group 3, bath temperatures above 105° F., such as 115° to 135° F., are preferred, with time periods above 60 seconds, and most preferably above 80 seconds, also being preferred.

In all cases, the presence of the hydroxylamine sulfate did not change the morphology from a needle-like or nodular structure, but retained the morphology associated with the application method and substrate, as well as the presence of the manganese, in addition to the nickel, in the amounts described and in the ratios with the other components such as the zinc and phosphate ions in the coating solution and the amount of the hydroxylamine employed. The coatings in the invention are accordingly of either the platelet or nodular (the latter in the case of immersion coating of CRS) crystalline structure, providing excellent coating weights in a low temperature application either by spray or immersion techniques. The hydroxylamine accelerator may be added to the concentrate itself, avoiding the necessity of adding it when the coating solution is being later formulated from the concentrate. The coating solution requires, and preferably has, no nitrite ion as an accelerator, thereby reducing the adverse environmental impact and safety hazards often associated, or at least believed by some customers to be associated, with nitrites.

EXAMPLE 7

The most preferred compositions according to the invention generally will provide a coating solution, for either spray or immersion, of the following ingredients in the amounts set forth below:

TABLE 4

| INGREDIENT | WT % |
|---|---|
| Hydroxylamine Sulfate | 0.168 |
| Zinc ions | 0.10 |
| Nickel ions | 0.05 |
| Manganese ions | 0.05 |
| Phosphate ions | 1.37 |
| Nitrate ions | 0.12 |
| Complex fluoride | 0.074 |
| Free fluoride | 0.022 |

In the foregoing composition, the zinc to phosphate ratio is 1:13.7 and the ratio of zinc to the sum of manganese and nickel is 1:1. With such compositions, phosphate coatings of high quality can be satisfactorily formed in desirable coating weights, not only on ferrous substrate such as cold rolled steel, but also on galvanized substrates, and on aluminum substrates.

EXAMPLE 8

As a practical matter, in coating operations, the coating solution may need to be replenished to maintain the appropriate levels of the materials in the coating solution and to maintain the acidity levels. Replenishing compositions will contain the various materials and ions in amounts effective, upon addition to the coating solution, to maintain the ions at the appropriate levels for coating and will normally contain ammonium carbonate or bicarbonate, and preferably ammonium hydroxide, in an amount effective, upon addition of the replenisher to the coating solution, to maintain the desired acidity level of the coating solution.

An example of a preferred replenishing composition for the coating solutions of the present invention has the following ingredients in the following parts by weight:

TABLE 5

| INGREDIENT | PARTS BY WEIGHT |
|---|---|
| Water | 270.2 |
| $H_3PO_4$ (75%) | 378.0 |
| Hydroxylamine Sulfate | 100.0 |
| MnO | 12.8 |
| ZnO | 68.0 |
| $Ni(140_3)_2$ Solution (30%) | 60.0 |
| HF (70%) | 2.5 |
| $H_2SiF_6$ (25%) | 50.0 |
| Ammonium Hydroxide (26° Baumé) | 58.5 |

EXAMPLE GROUP 9

As already noted above, the preferred hydroxylamine agent for compositions according to the invention is HAS. Use of this material leads to accumulation of sulfate in the coating compositions, as it is apparently not consumed by any reaction that is part of the phosphate conversion coating forming process. Therefore, experiments were undertaken to determine whether this accumulation has any adverse effect on either the formation of the phosphate coating or its protective value as undercoating for paint. The conversion coating compositions used that included sulfate had compositions as shown in Table 6 below.

TABLE 6

| BATH | TA (PTS.) | ZN (G/L) | MN (G/L) | NI (G/L) | $PO_4$ (G/L) | $NO_3$ (G/L) | F (G/L) | $SO_4$ (G/L) |
|---|---|---|---|---|---|---|---|---|
| 1 | 23.0 | 1.0 | 0.75 | 0.88 | 14.6 | 2.9 | 1.1 | 0.84 |
| 2 | 23.0 | 1.0 | 0.75 | 0.88 | 14.7 | 2.9 | 1.1 | 3.2 |
| 3 | 23.2 | 1.0 | 0.74 | 0.89 | 14.3 | 2.8 | 1.1 | 5.3 |
| 4 | 23.5 | 1.0 | 0.73 | 0.88 | 14.5 | 2.8 | 1.1 | 9.1 |
| 5 | 24.0 | 1~0 | 0.73 | 0.87 | 13.8 | 2.7 | 0.93 | 14.0 |

Notes for Table 6

All of these baths had a free acid value within the range from 0.6 to 0.7 points and a hydroxylamine sulfate concentration within the range from 0.15 to 0.175

The baths with compositions shown in Table 6 were made by preparing a concentrate in the same general manner with the same ingredients as in Examples 1 and 2 above, then diluting and adding appropriate amounts of sodium sulfate to give the sulfate concentrations shown in Baths 2–5 (the sulfate content in Bath 1 comes from the HAS used in the concentrate from which all the baths were prepared) to prepare the working coating compositions, which were used in the same manner as in Example Group 6, in particular, by forming the conversion coating by immersion for 120 seconds at 110° F. rather than spray contact. After conversion, the conversion coated samples were spray rinsed with water, treated with a solution having a pH of 6.3 and containing 1% v/v of Parcolene™80, a commercial post-treatment concentrate available from the P+A. The samples thus treated were rinsed in deionized water and then dried for 5 minutes in an oven maintained at 225° F.

These treatments produced a uniform coating on all substrates regardless of the sulfate concentration. Coatings of 193 to 281 mg/ft$^2$ (with 2 to 6 micron crystals), 244 to 262 mg/ft$^2$ (with 2 to 6 micron crystals), and 229 to 268 mg/ft$^2$ (with 2 to 12 micron crystals) were observed on the cold rolled steel, electrogalvanized, and hot dipped galvanized substrates respectively. Coating weights on the cold rolled steel decreased with increasing sulfate concentration, while those on electrogalvanized and hot dipped galvanized decreased slightly after the first addition of sulfate and from there on, remained relatively constant.

The samples prepared as described above were subsequently coated with conventional commercial paint or paint system coatings (PPG's ED-4 with General Motors Base Coat/Clear Coat system), and the samples thus coated were subjected to conventional accelerated corrosion resistance testing (APGE (20 Cycle), GM 9540P-B (40 cycle); Chrysler Chip (25 cycles of GM 9511P with shot impact)); and six month Florida exposure.

All four accelerated tests indicate that statistically, cold rolled steel3 s performance is not degraded with the accumulation of sulfate (up to 14 g/l) in a phosphate conversion coating composition according to this invention. In fact, at the higher sulfate levels (greater than 0.8 g/l), the cold rolled steel's performance in the 9540P-B, Chrysler Chip (x-scribe), and Florida Exposure tests appears to be statistically better than the performance of the control (Bath 1 in Table 6).

The performance of electrogalvanized steel may worsen as sulfate concentration is increased. The observed average creepage in millimeters across the scribe was always greater for all three tests at 14 g/l sulfate than at 0.8 g/l sulfate: 1.1 mm compared to 0.9 for the 9540P-B test, 2.5 compared to 2.3 for the Chrysler Chip test, and 3.9 compared to 3.3 for the APGE test. However, only the APGE results for 14 g/l sulfate were statistically significantly different from the control of 0.8 g/l. In contrast, the outdoor Florida Exposure testing suggests that a sulfate concentration of 5 to 14 g/l in a conversion coating forming composition according to the invention results in a statistically better electrogalvanized performance of 3.0 & 2.9 mm average creepage compared ro 3.4 mm for 0.8 and 3 g/l sulfate. Chrysler Chip testing of the electrogalvanized test panels resulted in a paint loss of 0.3 percent or less regardless of the sulfate concentration.

Statistically, depending upon the accelerated test, hot dipped galvanized zinc's performance improved, stayed the same, or degraded as the sulfate concentration increased. APGE and Florida Exposure testing shows the performance to decrease, GM 9540P-B show the performance to stay the same, and Chrysler Chip (x-scribe) shows the performance to improve. As with the electrogalvanized substrate, the hot dipped galvanized experienced no more than 0.3 percent paint loss from the chipping portion of the Chrysler Chip test.

The APGE and 6 month Florida Exposure tests, which produced, in general, larger creepages across the scribe than the 9540P-B or Chrysler Chip tests, appear to accentuate any potential negative influence of sulfate concentration on hot dipped galvanized steel's performance.

From this study it was concluded that sulfate levels up to 14 g/l do not reduce the performance of conversion coatings produced according to this invention on cold rolled steel substrates. Sulfate levels up to at least 6 g/l do not impair the performance on electrogalvanized steel. Sulfate levels of 9 g/l or greater may impede the performance on hot dipped galvanized steel, with testing which results in little creepage showing no performance reduction due to increasing sulfate concentration, while testing which results in large creepage indicates performance degradation. The former type of testing is probably more directly relevant to most conditions of practical use.

We claim:

1. A process for forming a crystalline zinc phosphate conversion coating on a metal surface by a process that includes the steps of:

(a) contacting the metal surface with an acidic conversion coating solution containing phosphate ions, zinc ions, and hydroxylamine sulfate for a time sufficient to form a crystalline zinc phosphate conversion coating;

(b) replenishing said coating solution with a replenishing ccmposition containing hydroxylamine sulfate to form a replenished coating solution; and (c) contacting said replenished coating solution with a metal substrate and replenishing said coating solution until the replenished coating solution exhibits a sulfate level of no more than 14 g/l.

2. A process according to claim 1 wherein said metal substrate is cold rolled steel.

3. A process according to claim 1 wherein said metal substrate is hot dipped galvanized steel and contact with said replenished coating solution is repeated until the replenished coating solution exhibits a sulfate level of no more than 9 g/l.

4. A process according to claim 3 wherein said acidic aqueous solution consists essentially of water and:

from about 0.8 to about 1.2 g/l of zinc ions;

from about 5 to about 25 g/l of phosphate ions;

from about 0.2 to about 1.5 g/l of manganese ions;

from about 0.2 to about 1.5 g/l of nickel ions; and from about 0.1 to about 0.25% of hydroxylamine, accelerator, measured as its stoichiometric equivalent as hydroxylamine, said acidic aqueous solution exhibiting:

a ratio of zinc ions to phosphate ions within the range from 1.0:about 10 to 1:about 25, a ratio of zinc ions to the sum of manganese and nickel ions within the range from 1.0:about 0.5 to 1.0:about 2.5, a ratio of manganese to nickel within the range from 1.0:about 0.5 to 1.0:about1.5, and a free acidity of about 0.3 to about 1.0 points.

5. A process according to claim 1 wherein said metal substrate is electrogalvanized steel and contact with said replenished coating solution is repeated until the replenished coating solution exhibits a sulfate level of no more than 6 g/l.

6. A process according to claim 1 wherein said acidic aqueous solution having no more than about 6.0 g/l of sulfate ions, a total acidity of about 17 to about 21 points, and a free acidity of about 0.4 to about 0.8 points.

7. A process according to claim 6, said acidic aqueous solution having a total acidity of about 19 to about 20 points and a free acidity of about 0.5 to about 0.7 points.

8. A replenished coating solution as used in step (c) of claim 1 wherein said coating solution exhibits a sulfate concentration of about 14 g/l.

9. A replenished coating solution for use in step (c) of claim 1 wherein said coating solution exhibits a sulfate concentration of about 14 g/l.

10. A replenished coating solution as used in step (c) of claim 1 wherein said coating solution has been contacted with electrogalvanized steel and exhibits a sulfate concentration of about 6 g/l.

* * * * *